US005941656A

United States Patent [19]

Sugiyama et al.

[11] Patent Number: 5,941,656

[45] Date of Patent: Aug. 24, 1999

[54] METHOD OF REINFORCING ASPHALT-PLACED CONCRETE STRUCTURE

[75] Inventors: Tetsuya Sugiyama; Makoto Saito, both of Tokyo, Japan

[73] Assignee: Tonen Corporation, Tokyo, Japan

[21] Appl. No.: 09/011,445

[22] PCT Filed: Jun. 6, 1997

[86] PCT No.: PCT/JP97/01943

§ 371 Date: Feb. 6, 1998

§ 102(e) Date: Feb. 6, 1998

[87] PCT Pub. No.: WO97/47819

PCT Pub. Date: Dec. 18, 1997

[30] Foreign Application Priority Data

Jun. 10, 1996 [JP] Japan ..... 8-171710

[51] Int. Cl.[6] ..... E01C 19/00; E01C 11/00; E01D 19/12; B31B 1/60

[52] U.S. Cl. ..... 404/20; 404/17; 404/70; 404/72; 404/82; 14/73; 156/60

[58] Field of Search ..... 14/73; 404/70, 404/73, 75, 82, 19, 20, 31, 17; 156/60

[56] References Cited

U.S. PATENT DOCUMENTS

| | | | |
|---|---|---|---|
| 1,884,795 | 10/1932 | McKesson | 404/31 |
| 3,030,251 | 4/1962 | La Bore et al. | 404/19 |
| 3,112,681 | 12/1963 | Gessler et al. | 404/31 |
| 3,334,555 | 8/1967 | Nagin et al. | 404/82 |
| 3,527,146 | 9/1970 | Garling | 404/19 |
| 4,151,025 | 4/1979 | Jacobs | 156/71 |
| 4,233,356 | 11/1980 | Jacobs | 428/244 |
| 4,545,699 | 10/1985 | Uffner et al. | 404/31 |
| 4,662,972 | 5/1987 | Thompson | 156/279 |
| 4,708,256 | 11/1987 | Miller | 404/31 |
| 4,957,390 | 9/1990 | Shoesmith | 404/70 |
| 5,539,569 | 7/1996 | Lasch et al. | 428/328 |
| 5,711,834 | 1/1998 | Saito | 156/153 |

FOREIGN PATENT DOCUMENTS

| | | |
|---|---|---|
| 62-253807 | 11/1987 | Japan . |
| 8-128211 | 5/1996 | Japan . |

*Primary Examiner*—Thomas B. Will
*Assistant Examiner*—Gary S. Hartmann
*Attorney, Agent, or Firm*—Seidul, Gonda, Lavorgna & Monaco

[57] ABSTRACT

The reinforcing method of the invention comprises the steps of removing asphalt from a concrete slab 2 of a road bridge, placing a reinforcing fiber sheet 20 onto the upper surface of the slab, preparing a fiber-reinforced composite material by impregnation with a resin 13 and causing the resin to set, coating an adhesive 22 onto a reinforcing material 21 comprising the foregoing composite material, sprinkling sand 23 thereover to form irregularities of sand 23 on the upper surface of the reinforcing material 21, hardening the adhesive 22, then coating a solvent-based asphalt primer 24 onto the sand 23, and placing asphalt 7 again, thereby completing the reinforcing operation.

17 Claims, 4 Drawing Sheets

METHOD OF REINFORCING ASPHALT-PLACED CONCRETE STRUCTURE

TECHNICAL FIELD

The present invention relates to a method of reinforcing a concrete structure provided with asphalt such as a road bridge floor slab, a parking lot slab or a warehouse slab.

BACKGROUND ART

A concrete structure such as a road bridge has so far been considered as a semi-permanent structure. There is however posed a problem in strength because factors such as a long time use, increase in the volume of traffic, and increase in the live load on automobiles have caused considerable deterioration of concrete surface and cracks. A counter-measure against this problem is to reinforce a concrete structure, and it is a common practice for this purpose to reinforce the same with carbon fibers impregnated with a resin.

This reinforcing method comprises sticking reinforcing fibers such as carbon fibers impregnated with a resin onto the concrete surface, and hardening the reinforcing fibers by causing setting of the resin, thereby forming a reinforcing material enhanced with fibers, i.e., forming a fibre-reinforced composite material (FRP). According to this practice, it is possible to reinforce the concrete structure with a high reinforcing effect since the reinforcing fibers in the reinforcing material firmly adhering to the concrete surface serve as a tension material through a high tensile strength thereof.

The reinforcing fibers used for such reinforcing purposes are applicable in the form of a reinforcing fiber sheet impregnated, upon use, with a resin, in which the reinforcing fibers are arranged in a single direction or in two directions through an adhesive layer on a support sheet, or in the form of a prepreg of a flexible sheet semi-hardened by previously impregnating the reinforcing fibers arranged in a single direction or in two directions with a resin.

When reinforcing a concrete structure such as, for example, a concrete slab of a road bridge, with reinforcing fibers serving as a tension material, the center portion is reinforced by sticking the reinforcing fibers impregnated with a resin onto the lower surface, since there occurs a moment tending to produce a downward convexity at the center portion thereof. In a protruding portion of the slab, on the other hand, a moment in a direction counter to that at the center portion is produced. It is therefore necessary to reinforce the slab from the upper surface.

Reinforcing from the upper surface is accomplished by removing asphalt placed on the concrete slab to expose the upper surface, sticking the reinforcing fibers impregnated with a resin to the upper surface, hardening the same, and then, placing asphalt onto the thus formed reinforcing material.

This practice is however defective in that it is impossible to ensure a high adhesivity between the reinforcing material and the placed asphalt, resulting in displacement of asphalt upon passage of an automobile.

A concrete slab other than a road bridge slab, i.e., a parking lot slab or a warehouse slab, is used in some cases by placing asphalt on the slab concrete surface. When reinforcing the upper surface of such a slab having asphalt placed thereon with reinforcing fibers, a problem is again that a sufficient adhesivity is unavailable between the reinforcing material based on the reinforcing fibers and asphalt. In a concrete floor surface having asphalt placed thereon for the purpose of achieving simplified waterproofing on a roof of a building as well, there is posed the problem of unavailability of a satisfactory adhesivity between the reinforcing material using reinforcing fibers and asphalt.

DISCLOSURE OF THE INVENTION

An object of the present invention is therefore to provide a method of reinforcing an asphalt-placed concrete structure, which permits reinforcement of a concrete surface on which asphalt is to be placed of a concrete structure such as a concrete slab of a road bridge with a reinforcing material based on reinforcing fibers while ensuring a high adhesivity between asphalt and the reinforcing material.

In summary, the present invention provides a method of reinforcing an asphalt-placed concrete structure, comprising the steps of placing reinforcing fibers impregnated with a resin onto the concrete surface on which asphalt is to be placed of a concrete structure, hardening the reinforcing fibers by causing the impregnating resin to set, thereby preparing a fibre-reinforced composite material, then coating an adhesive onto the fibre-reinforced composite material, sprinkling sand thereon, coating a solvent-based asphalt primer on the sand, and then, placing asphalt onto the fibre-reinforced composite material.

According to the invention, the quantity of coated adhesive should preferably be within a range of from 0.1 to 5.0 $kg/m^2$ per surface area of the fibre-reinforced composite material. The adhesive is a resin selected from thermosetting resins such as an epoxy resin, a polyester resin, a vinylester resin and a methylmethacrylate resin, and other resins. The sand should preferably have an average particle size within a range of from 1 to 10 mm. The quantity of sprinkled sand should preferably be within a range of from 0.5 to 5.0 $kg/m^2$ per surface area of the fiber-reinforced composite material. The quantity of coated solvent-based asphalt primer should preferably be within a range of from 0.02 to 1.2 $kg/m^2$ per surface area of the fiber-reinforced composite material as represented by the content of nonvolatile matters.

Further, according to the invention, the reinforcing fibers may be in the form of a reinforcing fibre sheet in which the reinforcing fibers are arranged in one direction or in two directions via the adhesive layer on a support sheet, or may be in the form of a sheet-shaped prepreg in which the reinforcing fibers arranged in one direction or in two directions is previously impregnated with a resin and semi-hardened. The reinforcing fibers may also comprise carbon fibers or aramide fibers, or hybrid fibers comprising a combination of carbon fibers with (1) a glass fiber, (2) a metal fiber such as boron fiber, titanium fiber or steel fiber, or (3) an organic fiber such as polyester fiber or nylon fiber. The concrete structure is a concrete slab, on the upper surface of which asphalt is to be placed.

BEST MODE FOR CARRYING OUT THE INVENTION

Now, the method of reinforcing an asphalt-placed concrete structure of the invention will be described further in detail with reference to the drawings.

The method of the invention is particularly characterized by reinforcing an asphalt-placed concrete surface of a concrete structure with a fiber-reinforced composite material (FRP), and upon placing asphalt onto the reinforcing material, providing irregularities with sand on the surface of the reinforcing material to improve adhesivity between the reinforcing material and the placed asphalt. The reinforcing method of the invention will be described below as to a typical concrete slab of a road bridge.

Figure 1A:
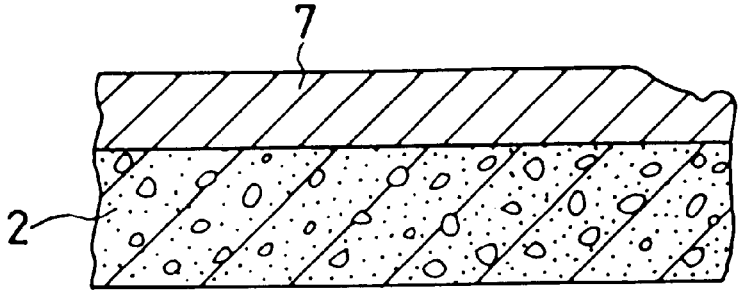
FIG. 1 illustrates steps in an embodiment of the reinforcing method of the invention.
Figure 1B:
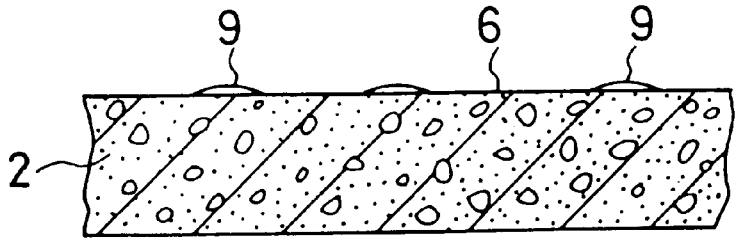
Figure 1C:
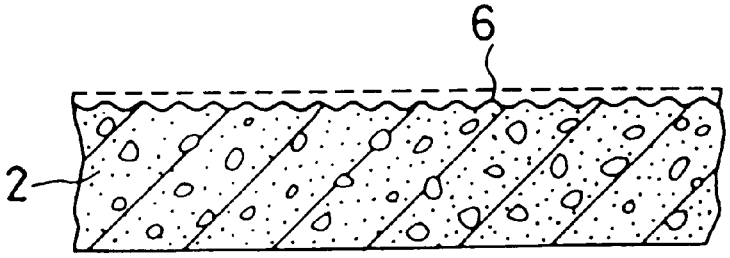
Figure 2A:
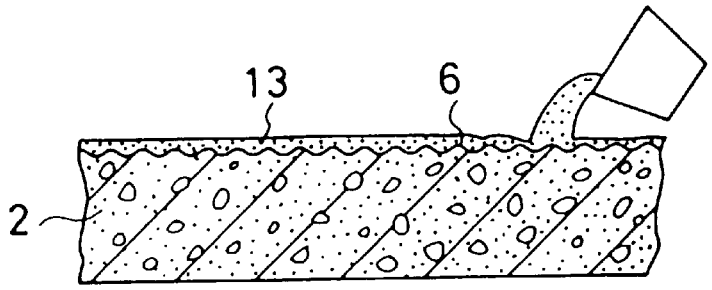
FIG. 2 is a process diagram illustrating the steps following those shown in FIG. 1.
Figure 2B:
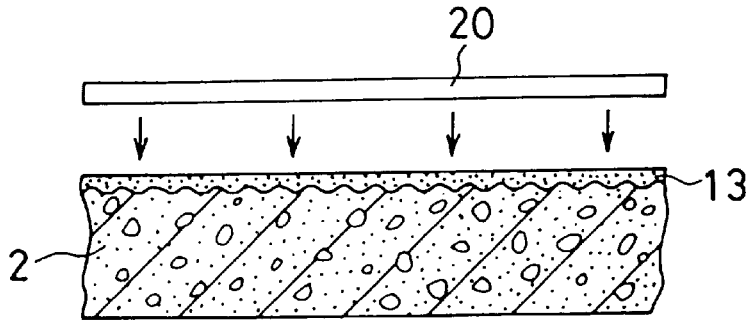
Figure 2C:
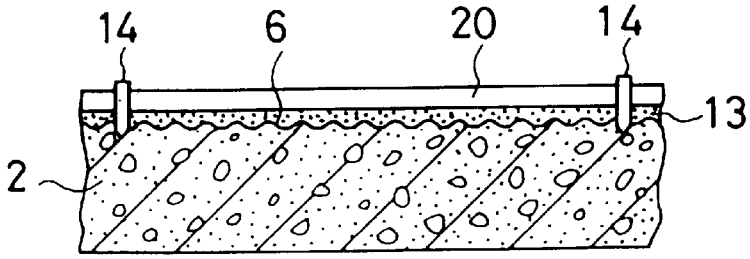
Figure 2D:
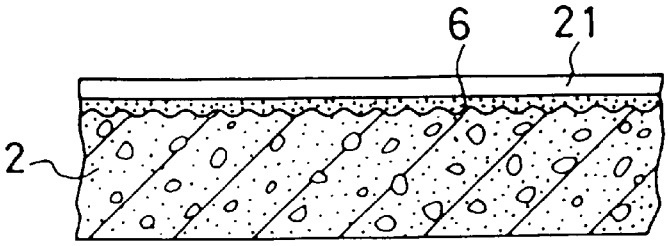
Figure 3A:
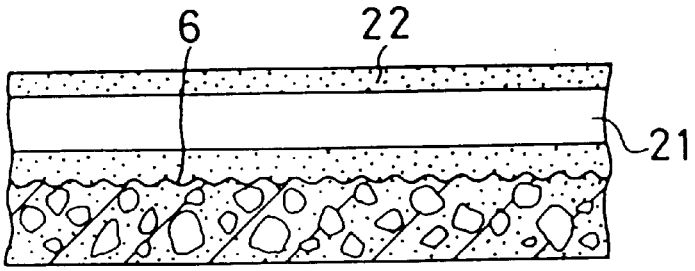
FIG. 3 is an enlarged process diagram illustrating the steps following those shown in FIG. 2.
Figure 3B:
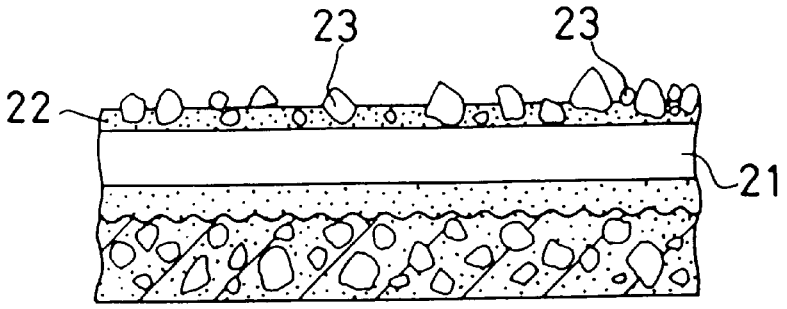
Figure 3C:
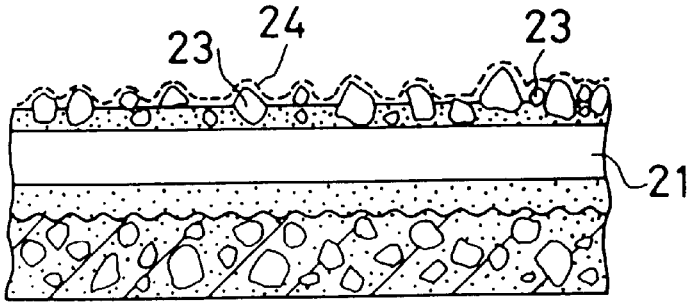
Figure 3D:
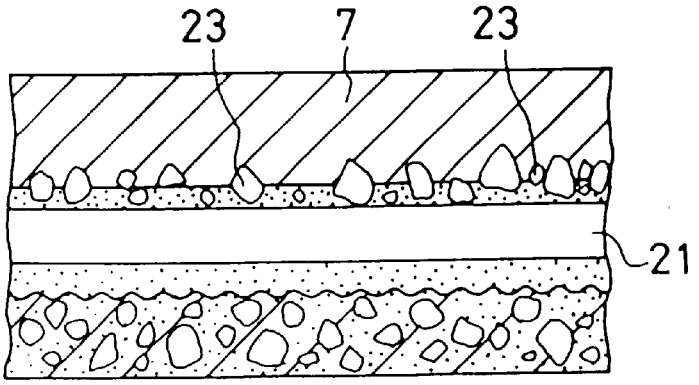

FIGS. 1 and 2 are process diagrams in an embodiment of the reinforcing method of the invention. In this embodiment, the upper surface of a concrete slab of a road bridge is reinforced by the use of a unidirectional reinforcing fibre sheet.

Figure 4:
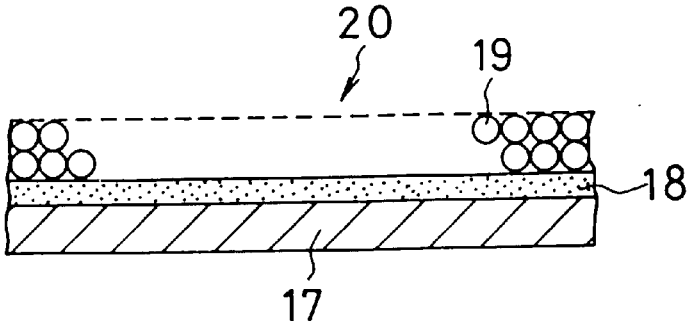
FIG. 4 is a sectional view illustrating a unidirectional reinforcing fiber sheet used in the invention.

The unidirectional reinforcing fibre sheet used in this embodiment is illustrated in FIG. 4. In this unidirectional reinforcing fiber sheet 20, reinforcing fibers 19 are arranged in a single direction via an adhesive layer 18 on a support sheet 17 such as a glass mesh. While glass fibers or carbon fibers are used as the reinforcing fibers 19, carbon fibers are particularly suitable. In this embodiment, a unidirectional reinforcing fibre sheet based on carbon fibers (carbon fiber sheet) is employed.

As shown in FIG. 1, asphalt 7 placed (paved) on the concrete slab 2 of a road bridge is broken by means of a rock drill (FIG. 1 (*a*) ), and removed by a power shovel or the like to expose the upper surface 6 of the slab 2 (FIG. (*b*)). Then, the upper surface 6 is cleaned or sanded (FIG. 1 (*c*)) by a disk sander or the like to remove oil 9 adhering to the upper surface 6. This sanding should preferably be applied so as to grind off more than 0.2 mm in thickness from the upper surface 6.

Because this sanding results in irregularities on the upper surface 6, placing of a reinforcing fibre sheet 20 impregnated with a resin causes thread twisting in the sheet 20, thus making it impossible to obtain a sufficient reinforcing effect. It is therefore the usual practice to conduct an irregularities adjustment of the upper surface 6 by coating a resin mortar with a trowel, and then, the reinforcing fibre sheet 20 impregnated with a resin is stuck. However, because this irregularities adjusting operation requires much labor and care, operation is carried out as shown in FIG. 2 in this embodiment.

More particularly, an irregularities adjustment of the upper surface 6 containing irregularities is not performed, but a thermosetting resin 13 is poured onto the upper surface 6 (FIG. 2 (*a*)). Then, the unidirectional reinforcing fibre sheet 20 is placed on the resin 13 (FIG. 2 (*b*)), and an anchor pin 14 is driven into the upper surface 6 of the slab 2 at an end thereof to hold the reinforcing fibre sheet 20 in a tightly stretched state. The reinforcing fibre sheet 20 is impregnated with the resin 13 while keeping this stretched state, and the reinforcing fibre sheet 20 thus impregnated with the resin is bonded to the upper surface 6 of the slab 2, thus completing placing of the reinforcing fiber sheet onto the upper surface (FIG. 2 (*c*)) .

As the foregoing thermosetting resin 13, an epoxy resin, a non-saturated polyester resin or a vinylester resin may be used. The resin 13 should preferably have a viscosity of up to 5,000 cps at 20° C. with a view to easily obtaining a flat surface of the resin 13 by pouring onto the upper surface 6 of the slab and to improving impregnating property into the reinforcing fibre sheet 20 placed on the resin 13.

For the purpose of causing the poured resin to spread over the entire upper surface 6 by reducing the sag stopping effect of the resin 13, thixotropics index TI at 20° C. should preferably be up to 3. Glass transition point Tg of the resin 13 should, furthermore, preferably be at least 60°C. In a slab 2 of a road bridge, in summer, asphalt tends to have such a high temperature as higher than 50° C. under the effect of the directly irradiated sunshine onto asphalt thereon. If the glass transition point Tg of the resin 13 impregnated into the reinforcing fibre sheet 20 is lower than this, or lower than 60° C. in consideration of safety, there would be an extreme decrease in tensile strength of the reinforcing fibre sheet, thus resulting in a serious decrease in the reinforcing effect.

After placing the reinforcing fibre sheet 20 impregnated with the resin on the upper surface 6 as described above, when the impregnated resin 13 is caused to thermally set, or when using a room-temperature-setting type thermosetting resin as the resin 13, the impregnated sheet is held further in the stretched state and cured, and the reinforcing fibre sheet 20 is hardened by causing the impregnated resin 13 to set. The sheet is then formed into a fiber-reinforced composite material, i.e., the reinforcing material 21, as shown in FIG. 2 (*d*). It is the conventional practice to place again asphalt 7 on the reinforcing material 21 thereafter, thus completing the reinforcing or repairing operation, but a satisfactory adhesivity of the reinforcing material and asphalt is unavailable.

In the invention, therefore, as shown in FIG. 3 (*a*), the adhesive 22 is coated onto the reinforcing material 21, and sand 23 is sprinkled and bonded (FIG. 3 (*b*)) to form irregularities with sand 23 on the upper surface of the reinforcing material 21. The irregularities on the upper surface of the reinforcing material 21 increase the mechanical bonding power with asphalt placed on the reinforcing material 21, and enlarge the adhering area with asphalt.

After integration of sand 23 onto the upper surface of the reinforcing material 21 by hardening of the adhesive 22, in order to improve affinity of sand 23 with asphalt, it suffices to coat a solvent-based asphalt primer 24 from above sand 23 (FIG. 3 (*c*)), and then to place asphalt onto the upper surface of the reinforcing material 21 (FIG. 3 (*d*)) .

As the foregoing adhesive 22, applicable resins include thermosetting resins such as an epoxy resin, a polyester resin, a vinylester resin and a methylmethacrylate resin (MMA) and other resins. An epoxy resin is particularly preferable. By using any of these resin adhesives, there is available a high adhesivity of sand with the reinforcing material 21. The quantity of coated adhesive should preferably be within a range of from 0.1 to 50 kg/m$^2$ per surface area of the reinforcing material 21. With a quantity of coated adhesive of under 0.1 kg/m$^2$, adhesivity of sand 23 with the surface of the reinforcing material 21 becomes insufficient, leading to peeling of sand 23 from the surface of the reinforcing material 21, thus making it impossible to sufficiently ensure an adhesivity of the upper surface of the reinforcing material 21 with asphalt 7. With a quantity of coated adhesive of over 5.0 kg/m$^2$, sand 23 is buried in the adhesive 22, and sufficient irregularities are not formed on the upper surface of the reinforcing material 21.

Since wetting reduces adhesivity, sand 23 is better when it is dried. It is not however necessary to heat for drying: it suffices to apply simultaneous drying. The average particle size of sand 23 should preferably be within a range of from 1 to 10 mm. With an average particle size of under 1 mm, irregularities of a sufficient size cannot be formed by sand 23, and an average particle size of over 10 mm, on the other hand, it becomes difficult to achieve integration of the reinforcing material 21 and the sand 23. The quantity of sprinkled sand should preferably be within a range of from 0.5 to 5.0 kg/m$^2$ per surface area of the reinforcing material 21. With a quantity of sprinkled sand 23 of under 0.5 kg/m$^2$, many irregularities cannot be formed. A quantity of sprinkled sand of over 5.0 kg/m$^2$ causes occurrence of much non-adhering sand, thus preventing achievement of a sufficient adhesivity of asphalt 7.

Chloroprene rubber or asphalt rubber may be used as a solvent-based asphalt primer. The quantity of coated primer should preferably be within a range of from 0.02 to 1.2 kg/m$^2$, as represented by the content of nonvolatile matters, per surface area of the reinforcing material 21. With a quantity of coated primer of under 0.02 kg/m$^2$, the surface of sand 23 adhering to the upper surface of the reinforcing material 21 cannot sufficiently be covered, leading to a poor affinity with placed asphalt 7. A quantity of coated primer of over 1.2 kg/m$^2$ results on the other hand in an excessively thick primer layer which reduces adhesivity of asphalt 7.

According to the concrete slab 2 of the road bridge reinforced as described above, irregularities are formed by integral sand 23 on the upper surface of the reinforcing material 21 comprising the fibre-reinforced composite material provided thereon. The asphalt 7 placed thereon can therefore be stuck thereto with a high mechanical bonding strength and a large adhering area, thus making it possible to ensure a sufficient adhesivity between the reinforcing material 21 and asphalt 7. Passage of automobiles therefore never causes displacement of asphalt 7, and it is possible to reinforce or repair the concrete slab 2 from the upper surface with no problem.

In the foregoing embodiment, the upper surface 6 of the concrete slab 2 of the road bridge is sanded. To omit the irregularities adjusting operation, therefore, there are followed the steps of pouring the resin 13 onto the upper surface 6, placing the reinforcing fibre sheet 20 in a stretched state, and impregnating the reinforcing fibre sheet 20 with the resin. For a concrete slab of a parking lot or a warehouse, it is possible to place the reinforcing fibre sheet 20 without conducting an irregularities adjusting operation.

A placing operation without an irregularities adjusting operation is accomplished by coating the slab concrete surface with a resin, sticking the reinforcing fibre sheet onto the resin-coated concrete surface, applying a pressure, and causing impregnation of the reinforcing fibre sheet with the coated resin, or by impregnating the reinforcing fibre with the resin and sticking the same to the concrete surface, or coating the concrete surface with an adhesive, sticking the reinforcing fibre sheet to the adhesive-coated concrete surface, coating the reinforcing fiber sheet thus stuck with the resin, and rubbing the coated resin against the reinforcing fiber sheet for impregnation.

In the foregoing embodiment, furthermore, a unidirectional reinforcing fiber sheet of carbon fibers (carbon fiber sheet) is used as the reinforcing fiber sheet 20. Aramide fibers may be used as the reinforcing fibers. As the reinforcing fibers, there are applicable hybrid fibers based on a combination of carbon fibers with one or more selected from the group consisting of a glass fiber, a metal fiber such as boron fiber, titanium fiber or steel fiber, and an organic fiber such as polyester fiber or nylon fiber. The reinforcing fiber sheet may further be a sheet in which the reinforcing fibers are arranged in lateral and longitudinal directions, or a mat-shaped reinforcing fibre sheet made by weaving the reinforcing fibers in lateral and longitudinal directions without a support sheet. Further, the reinforcing fibers may be used in the form of a sheet-shaped prepreg semi-hardened by previously impregnating with the resin, in which the reinforcing fibers are arranged in one direction or in two directions.

The reinforcing method of the invention is applicable not only for reinforcement or repair of a concrete slab of a road bridge, a parking lot slab or a warehouse slab, but also for reinforcement or repair of a concrete floor paved with asphalt for waterproofing of a roof of a building because of the excellent waterproofing property of the reinforcing material based on the fiber-reinforced composite material.

Now, the present invention will be described by means of some test examples.

Figure 5A:
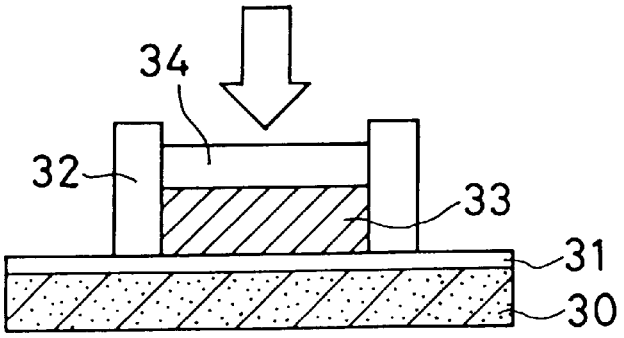
FIG. 5 is a sectional view illustrating a method of preparing a sample and an adhesivity test in an test example of the invention.
Figure 5B:
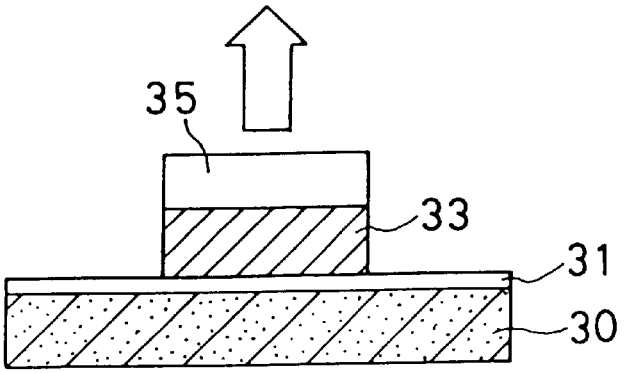

A test mortar plate having a thickness of 2 cm and sides of 7 cm (made by Nihon Test Panel Co.) was prepared. As shown in FIG. 5 (*a*), a carbon fiber sheet 31 (FORCA TOW SHEET FTS-C1-20, made by Tonen Corp.) impregnated with a resin was placed in a layer on a surface of the foregoing mortar plate 30. After setting of the resin, an epoxy adhesive (FR RESIN FR-E3P, made by Tonen Corp.) was coated on the carbon fiber sheet 31, and dried sand was sprinkled thereon. After hardening of the adhesive, an asphalt primer 33 (emulsion) is coated. Asphalt 33 was placed on the same to form an adhesivity test sample.

The particle size of the dried sand, the quantity of sprinkled sand, the kind of emulsion, and the quantity of coating are shown in Table 1. The dried sand comprised #6 sand (average particle size: 0.5 mm), #4 sand (1.0 mm) and leucite crushed stone (3 mm). The primer was a solvent-based CATICOAT R (made by Nichireki Co.), and a water-emulsion-based CATIOSOL (made by Nichireki Co.).

Asphalt 33 placing was accomplished by charging asphalt into a thickness of 2 cm by the use of an iron frame having an inside size of 4 cm×4 cm×4 cm on the carbon fiber sheet 31 coated with asphalt primer, placing the carbon fiber sheet 31 on a heat press, pressing a pressing steel plate 34 against asphalt 33 in the iron frame 32, and applying thermo-pressure forming. Upon placing asphalt 33, the mortar plate 30, the iron frame 32, asphalt 33 and the pressing steel plate 34 were previously heated to 150° C.

After cooling to room temperature, the adhesivity test sample was held for more than ten hours and then subjected to an adhesivity test. As shown in FIG. 5 (*b*), an adhesivity test steel attachment 35 was bonded to the upper surface of asphalt of the sample, and the assembly was attached to a tensile tester not shown. The adhesive test was carried out by drawing upward asphalt 33 via the attachment 35 by means of the tester.

The test sample was drawn at a target load stress rate of 1.0 kg/cm$^2$/second for two to five mm/minute. The fracture mode of the sample in this test is shown in Table 1. In Table 1, the interface fracture of fracture mode suggests that the sample was broken at the interface between a reinforcing fiber sheet (fiber reinforcing composite material) 31 and asphalt 33, and asphalt fracture occurred within asphalt 33. Adhesivity in the case of interface fracture is the strength upon interface fracture between the reinforcing fiber sheet 31 and asphalt 33, and adhesivity in the case of asphalt fracture is the strength upon internal fracture of asphalt 33.

TABLE 1

| No. | | QUANTITY OF COATED ADDHESIVE kg/m$^2$ | SAND PARTICLE SIZE mm | QUANTITY OF SPRINKLED SAND kg/m$^2$ | KIND OF PRIMER | QUANTITY OF COATED PRIMER (NONVOLATILE MATTER CONTENT) kg/m$^2$ | ADHE-SIVITY kgf/cm$^2$ | FRACTURE MODE |
|---|---|---|---|---|---|---|---|---|
| 1 | EXAMPLE OF INVENTION | 0.5 | 3.0 | 2.5 | SOLVENT-BASED | 0.15 | 4.5 | ASPHALT FRACTURE |
| 2 | EXAMPLE OF INVENTION | 0.4 | 3.0 | 2.5 | SOLVENT-BASED | 0.15 | 9.0 | ASPHALT FRACTURE |
| 3 | COMPARATIVE INVENTION | 0.05 | 3.0 | 2.5 | SOLVENT-BASED | 0.15 | 0.4 | INTERFACE FRACTURE |
| 4 | EXAMPLE OF INVENTION | 4.5 | 3.0 | 2.5 | SOLVENT-BASED | 0.15 | 3.2 | ASPHALT FRACTURE |
| 5 | COMPARATIVE INVENTION | 0.0 | 3.0 | 2.5 | SOLVENT-BASED | 0.15 | 1.0 | INTERFACE FRACTURE |
| 6 | EXAMPLE OF INVENTION | 0.5 | 1.0 | 2.5 | SOLVENT-BASED | 0.15 | 9.1 | ASPHALT FRACTURE |
| 7 | COMPARATIVE INVENTION | 0.5 | 0.3 | 2.5 | SOLVENT-BASED | 0.15 | 1.7 | INTERFACE FRACTURE |
| 8 | COMPARATIVE INVENTION | 0.5 | 3.0 | 0.9 | SOLVENT-BASED | 0.15 | 1.2 | INTERFACE FRACTURE |
| 9 | EXAMPLE OF INVENTION | 0.5 | 3.0 | 0.6 | SOLVENT-BASED | 0.15 | 3.7 | ASPHALT FRACTURE |
| 10 | EXAMPLE OF INVENTION | 0.5 | 3.0 | 4.0 | SOLVENT-BASED | 0.15 | 4.9 | ASPHALT FRACTURE |
| 11 | COMPARATIVE INVENTION | 0.5 | 3.0 | 6.0 | SOLVENT-BASED | 0.15 | 1.4 | INTERFACE FRACTURE |
| 12 | COMPARATIVE INVENTION | 0.5 | 3.0 | 2.5 | WATER EMULSION | 0.15 | 0.1 | INTERFACE FRACTURE |
| 13 | COMPARATIVE INVENTION | 0.5 | 3.0 | 2.5 | SOLVENT-BASED | 0.015 | 0.3 | INTERFACE FRACTURE |
| 14 | EXAMPLE OF INVENTION | 0.5 | 3.0 | 2.5 | SOLVENT-BASED | 0.05 | 3.7 | ASPHALT FRACTURE |
| 15 | EXAMPLE OF INVENTION | 0.5 | 3.0 | 2.5 | SOLVENT-BASED | 0.9 | 4.8 | ASPHALT FRACTURE |
| 16 | COMPARATIVE INVENTION | 0.5 | 3.0 | 2.5 | SOLVENT-BASED | 1.5 | 1.9 | INTERFACE FRACTURE |
| 17 | EXAMPLE OF INVENTION | 1.0 | 3.0 | 3.5 | SOLVENT-BASED | 0.4 | 4.1 | ASPHALT FRACTURE |
| 18 | EXAMPLE OF INVENTION | 0.8 | 1.0 | 1.5 | SOLVENT-BASED | 0.15 | 3.0 | ASPHALT FRACTURE |
| 19 | EXAMPLE OF INVENTION | 0.5 | 3.0 | 2.5 | SOLVENT-BASED | 0.4 | 4.4 | ASPHALT FRACTURE |
| 20 | COMPARATIVE INVENTION | NONE | NONE | NONE | NONE | NONE | 0 | INTERFACE FRACTURE |
| 21 | EXAMPLE OF INVENTION | 4.5 | 5.0 | 3.5 | SOLVENT-BASED | 1.2 | 3.1 | ASPHALT FRACTURE |
| 22 | COMPARATIVE INVENTION | 4.5 | 13.0 | 5.0 | SOLVENT-BASED | 1.2 | 1.0 | INTERFACE FRACTURE |
| 23 | EXAMPLE OF INVENTION | 4.5 | 10.0 | 5.0 | SOLVENT-BASED | 1.2 | 2.9 | ASPHALT FRACTURE |

As shown in Table 1, Nos. 3, 5, 7, 8, 11 to 13, 16, 20 and 22 outside the scope of conditions of the present invention, adhesivity is low between the reinforcing fiber sheet comprising the fiber-reinforced composite material and the reinforcing fiber sheet 31, and the sample was broken at the interface between the reinforcing fiber sheet 31 and asphalt 33. In Nos. 1, 2, 4, 6, 9, 10, 14, 15, 17 to 19, 21 and 23, satisfying the conditions of the invention, there was available a high adhesivity between the reinforcing fiber sheet 31 and asphalt 33: the sample was broken within asphalt 33, and there was available an adhesivity almost equal to that in direct placing of asphalt onto mortar, between the reinforcing fiber sheet 31 and asphalt 33.

INDUSTRIAL APPLICABILITY

According to the reinforcing method of the invention, as described above, it is possible to reinforce the surface of concrete on which asphalt is to be placed of a concrete structure such as a concrete slab of a road bridge by means of a reinforcing material based on a reinforcing fiber while keeping a high adhesivity with asphalt.

We claim:

1. A method of reinforcing an asphalt-placed concrete structure, comprising the steps of placing reinforcing fibers impregnated with a resin onto the concrete surface on which asphalt is to be placed of a concrete structure, hardening said reinforcing fibers by causing the impregnating resin to set, thereby preparing a fiber-reinforced composite material, then coating an adhesive onto said fiber-reinforced composite material, sprinkling sand thereon, coating a solvent-based asphalt primer on the sand, and then placing asphalt onto the fiber-reinforced composite material.

2. The reinforcing method according to claim 1, wherein said concrete structure is a concrete slab, on which the upper surface of which asphalt is to be placed.

3. The reinforcing method according to claim 1, wherein said adhesive is a resin selected from the group consisting of thermosetting resins including an epoxy resin, a polyester resin, a vinylester resin and a methylmethacrylate resin.

4. The reinforcing method according to claim 1, wherein said sand has an average particle size within a range of from 1 to 10 mm.

5. The reinforcing method according to claim 1, wherein the quantity of sprinkled sand is within a range of from 0.5 to 5.0 kg/m$^2$ per surface area of said fiber-reinforced composite material.

6. The reinforcing method according to claim 1, wherein the quantity of coated solvent-based asphalt primer, as represented by a content of nonvolatile matters, is within a range of from 0.02 to 1.2 kg/m$^2$ per surface area of said fiber-reinforced composite material.

7. The reinforcing method according to claim 1, wherein said reinforcing fibers are in the form of a reinforcing fiber sheet in which the reinforcing fibers are arranged in at least one direction via an adhesive layer on a support sheet.

8. The reinforcing method according to claim 1, wherein the reinforcing fibers are in the form of a sheet-shaped prepreg in which the reinforcing fibers are arranged in at least one direction and are previously impregnated with a resin and semi-hardened.

9. The reinforcing method according to claim 1, wherein the quantity of coated adhesive is within a range of from 0.1 to 5.0 kg/m$^2$ per surface area of said fiber-reinforced composite material.

10. The reinforcing method according to claim 9, wherein said adhesive is a resin selected from the group consisting of thermosetting resins including an epoxy resin, a polyester resin, a vinylester resin and a methylmethacrylate resin.

11. The reinforcing method according to claim 1, wherein the reinforcing fibers are at least one of carbon fibers, aramide fibers, and hybrid fibers comprising carbon fibers and at least one of (1) a glass fiber, (2) a metal fiber and (3) an organic fiber.

12. The reinforcing method according to claim 11, wherein the metal fiber is at least one of boron, titanium and steel.

13. The reinforcing method according to claim 11, wherein the organic fiber is at least one of polyester and nylon.

14. A method of increasing adhesion between a concrete structure and asphalt, comprising the steps of:

coating the concrete reinforcing material with an adhesive;

sprinkling a granular material onto the adhesive; and placing asphalt onto the granular material.

15. A method of increasing adhesion according to claim 14, wherein the granular material is sand.

16. A method of increasing adhesion between a concrete structure and asphalt, comprising the steps of:

adhering reinforcing fibers with a resin onto a concrete surface of the concrete structure;

allowing the resin to impregnate the reinforcing fibers and set thereby providing a fiber-reinforced composite material;

coating the fiber-reinforced composite material with an adhesive;

a sprinkling a granular material onto the adhesive; and placing asphalt onto the adhesive-sand mixture.

17. A method of increasing adhesion according to claim 16, wherein the granular material is sand.

* * * * *